US008958708B2

(12) United States Patent
Kojima

(10) Patent No.: US 8,958,708 B2
(45) Date of Patent: Feb. 17, 2015

(54) IMAGE FORMING APPARATUS HAVING VARIABLE POTENTIAL SETTING

(75) Inventor: Etsuji Kojima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 332 days.

(21) Appl. No.: 13/465,373

(22) Filed: May 7, 2012

(65) Prior Publication Data

US 2012/0288292 A1 Nov. 15, 2012

(30) Foreign Application Priority Data

May 11, 2011 (JP) ..... 2011-105842

(51) Int. Cl.
*G03G 15/02* (2006.01)
*G03G 15/043* (2006.01)

(52) U.S. Cl.
USPC ..... 399/50; 399/51

(58) Field of Classification Search
CPC ..... G03G 15/0266; G03G 15/043
USPC ..... 399/50, 51, 66
See application file for complete search history.

(56) References Cited

U.S. PATENT DOCUMENTS

| | | | | |
|---|---|---|---|---|
| 6,639,617 | B2 * | 10/2003 | Yokogawa | 347/130 |
| 7,010,238 | B2 * | 3/2006 | Park | 399/51 |
| 7,050,732 | B2 * | 5/2006 | Bae et al. | 399/50 |
| 7,848,671 | B2 | 12/2010 | Mochizuki | |
| 7,865,097 | B2 | 1/2011 | Ishikawa | |
| 7,899,349 | B2 * | 3/2011 | Shida | 399/66 |
| 8,041,244 | B2 | 10/2011 | Kojima | |

(Continued)

FOREIGN PATENT DOCUMENTS

| | | |
|---|---|---|
| CN | 101201571 A | 6/2008 |
| CN | 101369116 A | 2/2009 |
| CN | 101393410 A | 3/2009 |

(Continued)

OTHER PUBLICATIONS

Chinese Office Action dated Oct. 10, 2014, in related Chinese Patent Application No. 201210145601.2 (with English translation).

*Primary Examiner* — Robert Beatty
(74) *Attorney, Agent, or Firm* — Fitzpatrick, Cella, Harper & Scinto

(57) ABSTRACT

An image forming apparatus includes a first image forming portion including a first photosensitive member, a first charging member to electrically charge the first photosensitive member, and a first exposure member to expose to light the charged first photosensitive member to form an electrostatic latent image, and a second image forming portion including a second photosensitive member, a second charging member to electrically charge the second photosensitive member, and a second exposure member to expose to light the charged second photosensitive member to form an electrostatic latent image. In addition, a power source applies a common voltage to a first transfer portion and a second transfer portion, and a setting portion variably sets, for a period in which a transfer operation is performed, a potential of the exposed portion or the charged portion of the first photosensitive member and a potential of the exposed portion or the charged portion of the second photosensitive member on the basis of a plurality of currents passing through the first transfer portion and a plurality of currents passing through the second transfer portion, respectively, when the plurality of common voltages are applied to the first transfer portion and the second transfer portion in a period other than the period in which the transfer operation is performed.

8 Claims, 5 Drawing Sheets

(56) References Cited

U.S. PATENT DOCUMENTS

| | | | | |
|---|---|---|---|---|
| 8,068,755 | B2 | 11/2011 | Kojima | |
| 8,068,756 | B2 | 11/2011 | Ishikawa | |
| 8,270,861 | B2 * | 9/2012 | Takahashi et al. | 399/51 |
| 8,369,729 | B2 * | 2/2013 | Torimaru | 399/66 |
| 2002/0168195 | A1 | 11/2002 | Yokogawa | |

FOREIGN PATENT DOCUMENTS

| | | | | |
|---|---|---|---|---|
| CN | 101634824 | A | | 1/2010 |
| JP | 9-109512 | A | | 4/1997 |
| JP | 2001-125338 | A | | 5/2001 |
| JP | 2004-145187 | A | | 5/2004 |
| JP | 2008216680 | A | * | 9/2008 |

* cited by examiner

IMAGE FORMING APPARATUS HAVING VARIABLE POTENTIAL SETTING

FIELD OF THE INVENTION AND RELATED ART

The present invention relates to an image forming apparatus of an electrophotographic type, such as a copying machine, a printer, a facsimile machine, or a multi-function machine of these machines, in which a plurality of image forming portions are provided.

As the image forming apparatus of the electrophotographic type, a structure in which an intended image is visualized as a toner image by subjecting a surface of a photosensitive drum to an image forming process including steps of charging, exposure, development and the like and then the toner image is transferred onto a transfer material in a transfer step has been known.

Further, a structure in which a full-color image can be obtained by superposing toner images of a plurality of colors has also been conventionally known. As this structure, there is, e.g., a structure in which a plurality of image forming portions (image forming stations) are provided and toner images formed at the respective image forming portions are successively transferred onto the transfer material such as an intermediary transfer belt or a recording material.

Here, at a transfer portion where the toner image is transferred onto the transfer material at each of the image forming portions, a resistance is fluctuated depending on an environment at the transfer portion. For example, the transfer portion is constituted by nipping the intermediary transfer belt between a transfer roller and the photosensitive drum but it has been known that the resistance of the transfer roller or the intermediary transfer belt is fluctuated depending on a temperature and humidity in an ambient condition, the number of sheets subjected to image formation, or the like. By these resistance fluctuations, an optimum transfer voltage value for obtaining a good transfer image is always changed. Therefore, it is preferable that the transfer voltage value is set depending on these resistance fluctuations.

For example, when a voltage of a value lower than the optimum voltage value is applied as the transfer voltage, there is a possibility that a transfer property is lowered. Particularly, in the case of the full-color image forming apparatus, due to the lowering in transfer property, there is a possibility that color stability is impaired between an initial state and a state of image formation on a large number of sheets. Further, when a voltage of a value higher than the optimum voltage value is applied, abnormal electric discharge occurs at the transfer portion, so that there is a possibility that image defect due to the electric discharge occurs.

Therefore, a setting operation for setting the transfer voltage value at the optimum transfer voltage value has been proposed and employed (Japanese Laid-Open Patent Application (JP-A) 2001-125338). This setting operation will be described briefly. Before the image formation is started, an output voltage value when a predetermined current is passed through a transfer roller is detected. Depending on a corresponding relation between a current value and the detected output voltage value, a value of a transfer voltage applied to the transfer roller during image formation effected thereafter is set.

Incidentally, in the case of a full-color image forming apparatus of a tandem type, in order to effect image formation for a plurality of colors (e.g., four colors), a plurality of pairs (e.g., four pairs) of a developing device and a transfer means are needed. Driving devices for driving these developing devices and transfer means are connected to a high-voltage power sources (high-voltage sources) for each of the colors. Therefore, a plurality of power sources are required, so that a cost is increased.

For this reason, a cost reduction of the power source is tried by using a high-voltage source for color image formation common to three colors of cyan, magenta and yellow (JP-A Hei 9-109512). Further, particularly with respect to a primary transfer high voltage, its power source is tried to be made common to respective stations (JP-A 2004-145187).

In the case where a power source for applying the transfer voltage at a plurality of image forming stations is made common to the image forming stations in the constitution of JP-A Hei 9-109512 and JP-A 2004-145187 described above, the same voltage is applied to each of the stations. For this reason, in the case where a resistance of the transfer roller varies at each station depending on a manufacturing variation or a temperature gradient for a temperature rise in the image forming apparatus, an optimum voltage cannot be applied at each station.

In such a case, an output current value with respect to a value of a constant voltage applied to the transfer roller is different at each of the image forming stations. As a result, at the station where the output current value is outside of a proper range, there is a possibility of an occurrence of improper transfer or image defect due to abnormal electric discharge.

SUMMARY OF THE INVENTION

A principal object of the present invention is to provide an image forming apparatus capable of reducing a degree of an occurrence of improper transfer or image defect due to abnormal electric discharge, in which commonalty of a transfer power source is realized.

Another object of the present invention is to provide an image forming apparatus, in which commonality of the transfer power source is realized, capable of reducing the degree of the occurrence of the improper transfer or the image defect due to the abnormal electric discharge by passing an optimum current through each of a first transfer means and a second transfer means even in the case where a resistance value or the like is different between the first transfer means and the second transfer means.

According to an aspect of the present invention, there is provided an image forming apparatus comprising: a first image forming portion including a first photosensitive member, first charging means for electrically charging the first photosensitive member, first exposure means for exposing to light the charged first photosensitive member to form an electrostatic latent image, first developing means for forming a toner image by depositing a toner on an exposed portion of the electrostatic latent image, and first transfer means for transferring the toner image from the first photosensitive member onto a transfer material; a second image forming portion including a second photosensitive member, second charging means for electrically charging the second photosensitive member, second exposure means for exposing to light the charged second photosensitive member to form an electrostatic latent image, second developing means for forming a toner image by depositing a toner on an exposed portion of the electrostatic latent image, and second transfer means for transferring the toner image from the second photosensitive member onto the transfer material; a power source for applying a common voltage to the first transfer means and the second transfer means; and setting means for variably setting, for a period in which a transfer operation is performed, a potential of the exposed portion of the first photosensitive member exposed by the first exposure means and a potential of the exposed portion of the second photosensitive member exposed by the second exposure means on the basis of a current passing through the first transfer means and a current passing through the second transfer means, respectively, when the common voltage is applied to the first transfer means and the second transfer means in a period other than the period in which the transfer operation is performed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiments of the present invention will be described with reference to FIGS. 1 to 5.

[Image Forming Apparatus]

First, an image forming apparatus in an embodiment of the present invention will be described with reference to FIGS. 1 and 2. An image forming apparatus 100 is a full-color laser printer or a tandem type in which a plurality of image forming portions Pa, Pb, Pc and Pd for magenta (M), cyan (C), yellow (Y) and black (K), respectively are provided along an intermediary transfer belt 7 as a transfer material. In this embodiment, any combination of two of all the image forming portions Pa, Pb, Pc and Pc provides a relationship between a first image forming portion and a second image forming portion.

At the image forming portions Pa, Pb, Pc and Pd, toner images of magenta, cyan, yellow and black, respectively, are formed. The respective image forming portions have the same constitution except that the colors of the toners used in developing devices 4*a*, 4*b*, 4*c* and 4*d* are different from each other. Therefore, in FIG. 2, suffixes, a, b, c and d for discriminating the four image forming portions are omitted and the constitution and operation will be collectively described.

Figure 2:
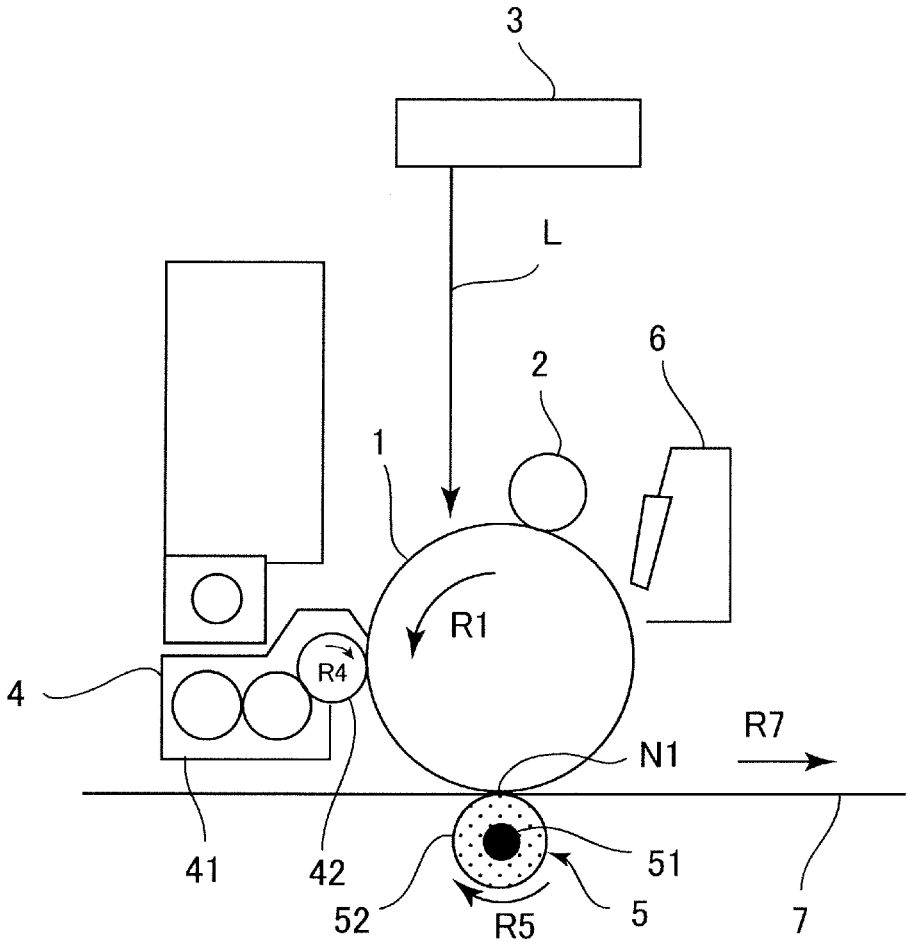
FIG. 2 is a schematic illustration of an image forming portion.

As shown in FIG. 2, a photosensitive drum 1 (photosensitive member) provided at the image forming portion P is rotationally driven in an arrow R1 direction at a process speed (peripheral speed) of, e.g., 100 mm/sec by a driving means (not shown). Around the photosensitive drum 1, along a rotational direction of the photosensitive drum 1, a charging roller 2, an exposure device 3, the developing device 4, a primary transfer roller 5 and a cleaning device 6 are provided substantially in this order. The charging roller is a charging means. The exposure device 3 corresponds to an exposure means. The developing device 4 corresponds to a developing means. The primary transfer roller 5 corresponds to a transfer means. Further, the charging roller 2 and the exposure device 3 constitute an electrostatic latent image forming means.

The rotationally driven photosensitive drum 1 is charged at its surface by the charging roller 2 by applying a voltage to the charging roller 2. The charging roller 2 is contacted to the surface of the photosensitive drum 1, and a charging bias is applied to the charging roller 2 by a charging bias application voltage (power) source (not shown). As a result, the surface of the photosensitive drum 1 is uniformly charged to, e.g., −600 V. Here, the charging bias application voltage source is provided for each of the stations (image forming portions) and is capable of applying an arbitrary charging bias without being limited to −600 V.

On the surface of the photosensitive drum 1 after being charged, an electrostatic latent image is formed by the exposure device 3. The exposure device 3 emits laser light L on the basis of image information, so that the surface of the photosensitive drum 1 is exposed to the laser light L. The surface of the photosensitive drum 1 after being charged is subjected to removal of the electric charge at an exposed portion, so that the electrostatic latent image is formed. Also an output of the laser light L of the exposure device 3 is settable.

When the electrostatic latent image formed on the surface of the photosensitive drum 1 reaches the developing device 4, the electrostatic latent image is developed with a toner of each color. The developing device 4 includes a developing container 41 for accommodating a two-component developer containing non-magnetic toner particles (toner) and a magnetic carrier (carrier) in mixture. The developer is stirred in the developing container 41, so that the non-magnetic toner particles are negatively charged.

The developer is carried on a developing sleeve 42 rotating in an arrow R4 direction. When a developing bias including a negative DC component is applied to the developing sleeve 42 by a developing bias voltage (power) source (not shown), the non-magnetic toner particles carried on the surface of the developing sleeve 42 are transferred onto the electrostatic latent image formed on the surface of the photosensitive drum 1, thus developing the electrostatic latent image as a toner image.

Then, the toner image formed on the photosensitive drum 1 is primary-transferred onto an intermediary transfer belt 7 (transfer material) by the primary transfer roller 5 to which a positive transfer voltage is applied. For example, the toner image formed on the photosensitive drum 1*c* of the image forming portion Pc is primary-transferred onto the intermediary transfer belt 7. Similarly, the toner image formed on the photosensitive drum 1*d* of the image forming portion Pd is primary-transferred onto the intermediary transfer belt 7.

The primary transfer roller 5 is constituted by providing a cylindrical electroconductive layer 52 on an outer peripheral surface of a metal shaft 51. The primary transfer roller 5 is, e.g., 16 mm in diameter and, e.g., $1\times10^7\Omega$ in resistance value. This resistance value was measured by placing the primary transfer roller 5 on a metal plate and thereby applying a voltage of 50 V between the plate and the shaft 51.

Further, in this embodiment, at the four image forming portions, Pa, Pb, Pc and Pd, all the resistance values of the primary transfer rollers 5 are substantially equal to each other. The resistance value of the primary transfer roller 5 is not limited to the above value but can be in a range of $1\times10^5\Omega$ to $9\times10^7\Omega$. The primary transfer roller 5 urges the intermediary transfer belt 7 toward the photosensitive drum 1. As a result, between the surface of the photosensitive drum 1 and the surface of the intermediary transfer belt 7, a primary transfer portion N1 is formed. The primary transfer roller 5 is rotated in an arrow R5 direction by the rotational drive of the intermediary transfer belt in an arrow R7 direction. The toner image formed on the surface of the photosensitive drum 1 is primary-transferred electrostatically onto the intermediary transfer belt 7*a* at the primary transfer portion N1 by the primary transfer roller 5 to which a primary transfer voltage is applied from a primary transfer high-voltage source (power source) 54.

As described above, the toner images of magenta, cyan, yellow and black formed on the respective photosensitive drums 1 of the image forming portions Pa to Pd are, when the primary transfer voltage is applied to the primary transfer roller 5 at each image forming portion, successively primary-transferred superposedly onto the intermediary transfer belt 7. The image forming portions are provided at an interval of, e.g., 70 mm.

In this embodiment, a constitution such that a common voltage is applied from the primary transfer high-voltage source 54 to the primary transfer rollers 5*a* to 5*d* is employed. That is, the primary transfer high-voltage source 54 applies the voltage of the same voltage to all the primary transfer rollers 5*a* to 5*d*. As shown in FIG. 1, between the primary transfer high-voltage source 54 and the primary transfer rollers 5*a* to 5*d*, current detecting devices (detecting means) 53*a*, 53*b*, 53*c* and 53*d* are provided so as to detect currents passing through the primary transfer rollers 5*a* to 5*d*.

The toner (residual toner) remaining on the surface of the photosensitive drum 1 without being transferred onto the intermediary transfer belt 7 during the primary transfer is removed by a cleaning blade of the cleaning device 6. Thus, the photosensitive drum 1 having the cleaned surface is subjected to subsequent image formation starting from the charging.

Incidentally, in this embodiment, the photosensitive drum 1, the charging roller 2, the developing device 4 and the cleaning device 6 which are described above are integrally incorporated into a cartridge container (not shown) to constitute a (process) cartridge as a whole. This cartridge is constituted so as to be detachably mountable to an image forming apparatus main assembly and, e.g., when the photosensitive drum 1 reaches the end of its lifetime, the entire cartridge is taken out of the image forming apparatus main assembly to be replaced with a new (fresh) cartridge.

Figure 1:
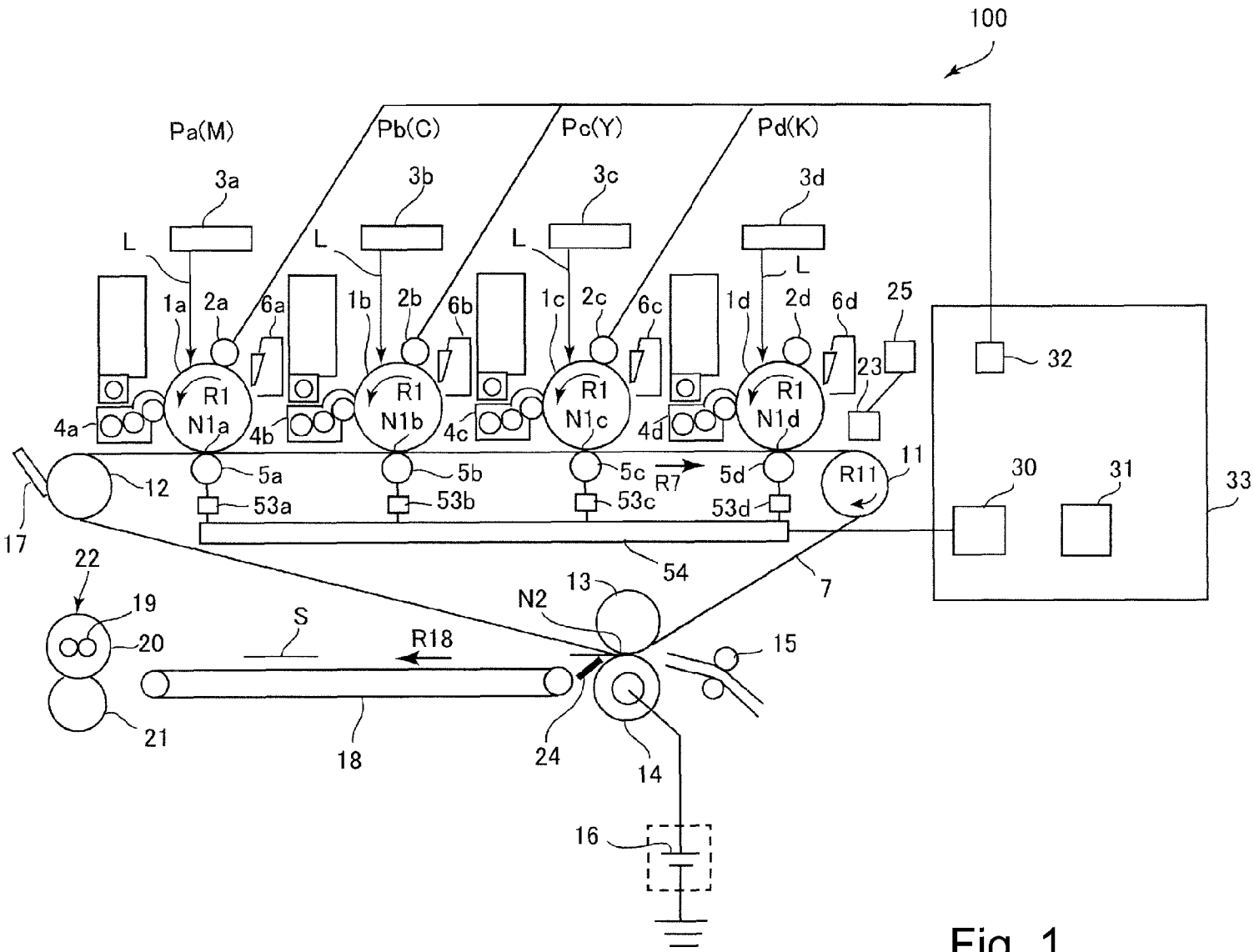
FIG. 1 is a schematic illustration of an image forming apparatus according to an embodiment of the present invention.

As described above, the intermediary transfer belt 7 onto which the respective toner images are primary-transferred is constituted in an endless shape and is extended around three rollers, i.e., a driving roller 11, a follower roller 12 and a secondary transfer opposite roller 13 as shown in FIG. 1. Further, with rotation of the driving roller 11 in an arrow R11 direction (in the clockwise direction in FIG. 1), the intermediary transfer belt 7 is moved in the arrow R7 direction. The intermediary transfer belt 7 is formed, in the endless shape, of a dielectric resin material such as polyimide, polycarbonate, polyethylene terephthalate or polyvinylidene fluoride. In this embodiment, a 50 μm-thick resin between formed of polyimide in the endless shape and of $1\times10^{9}$ Ω·cm in volume resistivity was used. Further, the intermediary transfer belt 7 has a surface resistivity (resistance) of $1\times10^{12}$ Ω/sq. However, the surface resistivity of the intermediary transfer belt 7 is not limited to this value but can be in a range of $1\times10^{11}$ Ω/sq to $9\times10^{13}$ Ω/sq. The surface resistivity was measured in accordance with JIS K 6911 under application of a voltage of 100 V.

At a position, of the outer peripheral surface of the intermediary transfer belt 7, corresponding to the secondary transfer opposite roller 13, a secondary transfer roller (secondary transfer means) 14 is contacted to the intermediary transfer belt 7. Between this secondary transfer roller 14 and the intermediary transfer belt 7, a secondary transfer portion (secondary transfer means) N2 is formed. The secondary transfer opposite roller 13 is a metal roller and is electrically grounded. The secondary transfer roller 14 is prepared by forming a cylindrical electroconductive rubber around a metal shaft and has a diameter of 20 mm.

The four color toner images which are primary transferred at the respective image forming portions and which are superposed on the intermediary transfer belt 7 are secondary-transferred onto a recording material S by the secondary transfer roller 14. That is, to the secondary transfer roller 14, a positive secondary transfer bias is applied from a secondary transfer bias application voltage (power) source 16 when the recording material S passes through the secondary transfer portion N2. As a result, the four color toner images are secondary-transferred collectively from the intermediary transfer belt 7 onto the recording material S. The toner (residual toner) remaining on the intermediary transfer belt 7 without being transferred onto the recording material S at this time is removed by a belt cleaner 17 provided at a position where the belt cleaner 17 opposes the follower roller 12.

The recording material S subjected to the image formation is accommodated in a sheet feeding cassette (not shown). The recording material S accommodated in the sheet feeding cassette is conveyed to registration rollers 15 by a sheet feeding and conveying device including a sheet feeding roller, a conveying roller, a conveying guide and the like (which are not shown), and oblique movement of the recording material S is corrected by the registration rollers 15 and then the recording material S is supplied to the above-described secondary transfer portion N2.

The recording material S on which the toner images are secondary-transferred is, after being subjected to removal of the electric charge by a charge-removing needle 24 which is electrically grounded, conveyed to a fixing device 22 by a conveying belt 18 rotating in an arrow roller 18 direction. The fixing device 22 includes a fixing roller 20 in which a heater 19 is incorporated and includes a passing roller 21 urged against the fixing roller 20 to form a fixing nip. The recording material S is heated and pressed by the fixing roller 20 and the pressing roller 21 when the recording material S passes through the fixing nip, so that the toner images are fixed on the surface of the recording material S. The recording material S after being subjected to the toner image fixation is discharged to the outside of the image forming apparatus main assembly. As a result, four-color based full-color image formation on a sheet of the recording material S is ended.

In this embodiment, a density sensor 23 is provided so as to be opposite a surface portion of the intermediary transfer belt 7 which is extended and contacted around the driving roller 11. The density sensor 23 is constituted by a reflection sensor including a light-emitting element (LED) and a light receiving element. On the intermediary transfer belt 7, a toner image for detecting a density of the color (hereinafter referred to as a "detection toner image") is formed at each of the image forming portions Pa, Pb, Pc and Pd. The density sensor detects a reflected light quantity of the detection toner image. A detection result thereof is set to a density control means 25. The density control means 25 computes a toner amount per unit area on the intermediary transfer belt 7 on the basis of the reflected light quantity detected by the density sensor 23. Further, based on the computation result, a supply amount of the non-magnetic toner is controlled, so that a proportion between the magnetic carrier and the non-magnetic toner which are accommodated in the developing container 41 is changed or a potential or the like of the photosensitive drum 1 charged by the charging roller 2 is controlled.

<Primary Transfer Voltage Control>

Next, a setting method of the primary transfer voltage in this embodiment will be described. With respect to the primary transfer roller 5, it is difficult to suppress a variation in resistance during manufacturing and in addition, the resistance changes also depending on deterioration by the image formation (endurance deterioration).

Therefore, the primary transfer voltage is set depending on the change in resistance by using control which is called ATVC (active transfer voltage control). This ATVC is effected at each of the image forming portions but may be effected separately or collectively. In this embodiment, the ATVC is effected collectively.

In the ATVC, first, with timing other than the time when a normal transfer operation is performed, in a state in which the photosensitive drum 1 is charged to a predetermined potential, a plurality of voltages for a test (test voltages) different in amplitude (value) are applied to the primary transfer roller 5. The ATVC is executed in, e.g., a warming-up period after power-on of the image forming apparatus until a temperature of the fixing device is increased up to a rise temperature or in a period in which a transfer operation after an end of printing on a predetermined number of sheets (e.g., 500 sheets) is not performed. Then, a current passing through the primary transfer roller 5 at that time is detected by a current detecting device 53. Then, from a voltage-current relationship at that time, a voltage at which a predetermined current (target current) flows is calculated, so that a temporarily primary transfer voltage to be applied to the primary transfer roller 5 at each of the image forming portions is set.

More specifically, in the ATVC in this embodiment, charge potentials Vda, Vdb, Vdc and Vdd of the surfaces of the photosensitive drums 1 at the respective image forming portions are set at −600 V. Then, in a state in which the photosensitive drum 1 is charged to the surface potential of −600 V, a primary transfer power source controlling device (controller) 30 controls the primary transfer high-voltage source 54 to successively apply test voltages at three levels (Vft1, Vft2, Vft3) to the primary transfer roller 5. The values of the test voltages can be arbitrarily set at each of the image forming portions (Pa, Pb, Pc, Pd) but in this embodiment, the same voltages were used at all of the image forming portions, Vft1=+100 V, Vft2=+200 V and Vft3=+300 V were used.

Each test voltage is applied during at least one full turn of the primary transfer roller 5. This is because the resistance of the primary transfer roller 5 varies with respect to a circumferential direction. During the application of each test voltage, the current detecting device (detecting means) 53 measures an amount of the current passing through the primary transfer roller 5.

A current detecting time T from start of the application of the first test voltage to end of the application of the third test voltage is determined by taking into a consideration of the diameter (16 mm) of the primary transfer roller 5*d* and a moving speed (140 mm/sec) of the intermediary transfer belt 7. That is, the current detecting time T was determined as 1.0 sec from (16×3.14/140)×3=1.07 . . . .

Figure 3:
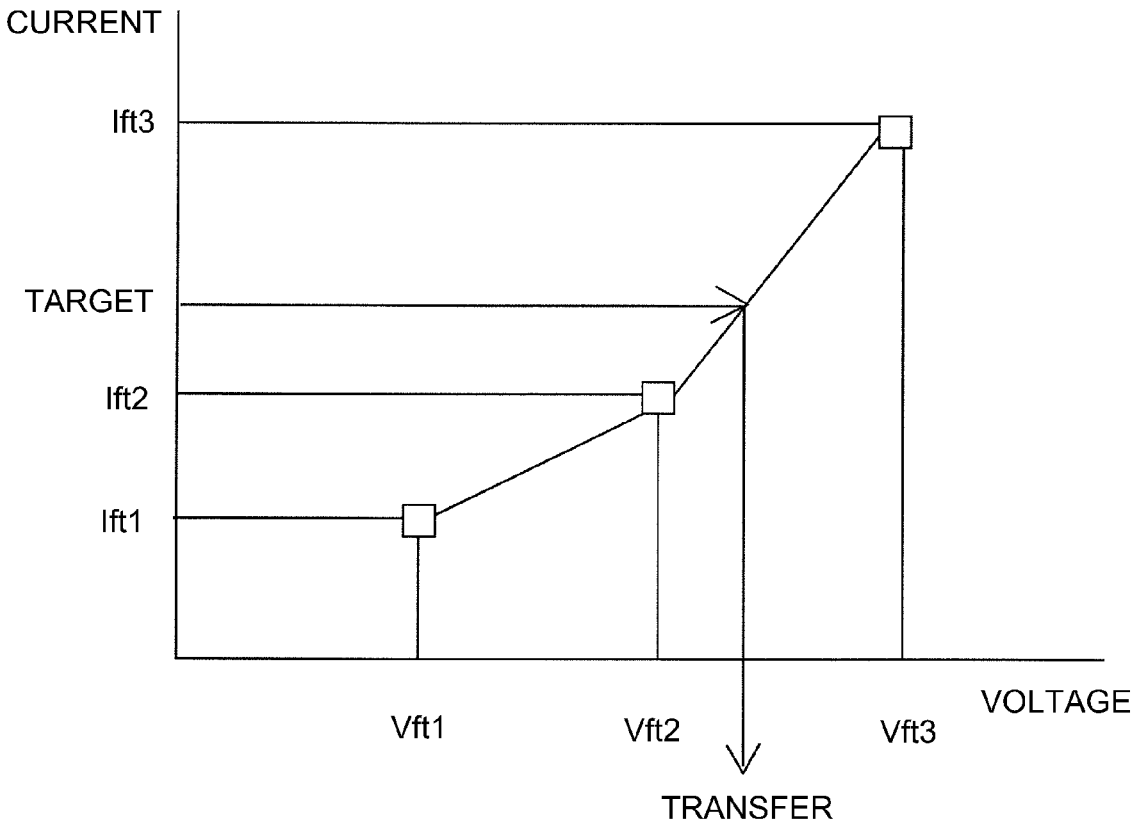
FIG. 3 is a graph showing a relationship between a transfer voltage and a current.

The primary transfer power source controller 30 obtains a voltage-current relationship shown in FIG. 3 from currents (detection result) Ift1, Ift2 and Ift3 passing through the primary transfer roller 5 when the test voltages Vft1, Vft2 and Vft3 are applied. The relationship shown in FIG. 3 is obtained every image forming portion. In this embodiment, the relationship at the image forming portion Pd is shown in FIG. 3. In FIG. 3, Ift1=5 μA, Ift=8 μA and Ift3=15 μA were obtained.

Further, on the basis of this relationship, the voltage corresponding to a target current value is set as the primary transfer voltage. The target current value in the ATVC at the image forming portion Pd is 10 μA. Further, the target current values in the ATVC effected thereafter at the image forming portions Pc, Pb and Pa are also 10 μA which is the same as that at the image forming portion Pd. From the relationship shown in FIG. 3, the primary transfer voltage at the image forming portion Pd is determined as Vtd=+245 V.

Similarly, an optimum applied voltage is obtained for each of the image forming portions. In this embodiment, calculation of the optimum applied voltage is performed at a dark portion potential (charge potential) of the photosensitive drum (Vd=−600 V in this embodiment). Further, in this embodiment a potential difference between the dark portion potential (Vd) and a light portion potential (Vl) is set at a constant value and therefore the light portion potential (Vl) can be uniquely determined.

Figure 4:
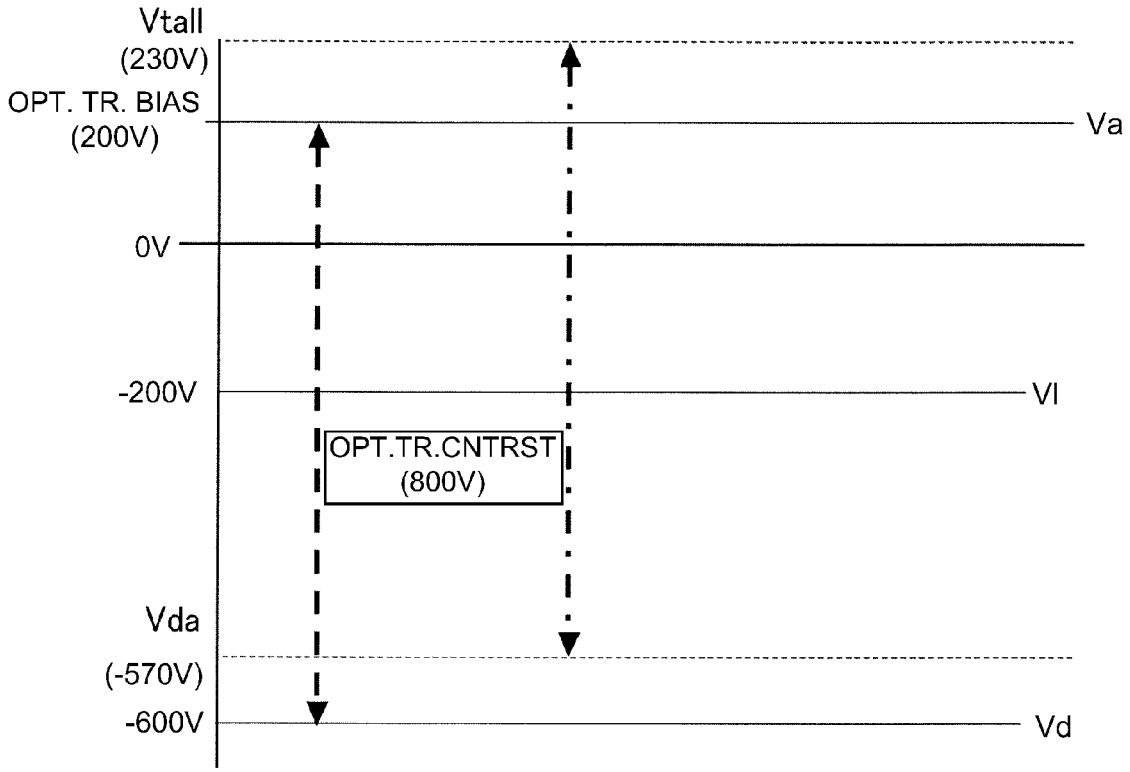
FIG. 4 is a graph for illustrating a transfer contrast.

FIG. 4 shows a relationship between the dark portion potential Vd and an optimum transfer bias (voltage) Va. For example, in the case of Vd=−600 V and Va=200 V, a potential difference between Vd and Va (transfer contrast) is 800 V. By setting the potential difference at 800 V, the current value of 10 μA is obtained. For example, under the same condition, in the case of Vd=−500 V, the optimum transfer bias (voltage) Va for obtaining the same transfer current of 10 μA is Va=300 V. This is because when Va=300 V, the resultant transfer constant is 800 V.

Incidentally, in this embodiment, the target current value at the dark potential portion is 10 μA but it is also possible to employ a method in which the target current value at the dark potential portion is obtained in advance and the light portion potential is set in advance by obtaining the transfer contrast providing the target current from the relationship similar to that shown in FIG. 3 and then the dark portion potential is set.

Further, the above-described dark portion potential of −600 V is a value which is determined for the image forming apparatus in advance. Therefore, depending on the image forming apparatus, the dark portion potential can be a numerical value other than −600 V in some cases. In such cases, the transfer contrast for obtaining the current value of 10 μA can also be a numerical value other than 800 V.

In this embodiment, the primary transfer high-voltage source 54 is common to the image forming portions Pa to Pd and therefore the same transfer voltage is applied to all of the image forming portions Pa to Pd during the transfer operation. For this reason, even when the optimum transfer voltage is obtained for each of the image forming portions as described above, the optimum transfer voltages cannot be applied to the image forming portions, respectively. Therefore, in this embodiment, the following calculation is effected to determine a voltage to be applied from the primary transfer high-voltage source 54.

First, the optimum transfer biases obtained for the respective image forming portions by the ATVC as described above were Vta=200 V at the image forming portion Pa, Vtb=260 V at the image forming portion Pb, Vtc=215 V at the image forming portion Pa and Vtd=245 V at the image forming portion Pd. That is, when the respective voltages are applied to the associated primary transfer rollers 5 at the respective image forming portions, the transfer current of 10 μA can be obtained at all of the image forming portions. In this embodiment, these voltages are used as temporarily set voltages.

Next, an average of these temporarily set voltages is used as a transfer voltage to be applied from the primary transfer high-voltage source 54.

That is, the average Vave is obtained by the following equation:

$$Vave=(Vta+Vtb+Vtc+Vtd)/4$$

When the above-described numerical values are substituted into the above equation, a transfer voltage Vtall is as follows.

$$Vtall=Vave=(200+260+215+245)/4=230\text{ V}$$

In the case where the thus set transfer voltage of 230 V is applied to all of the primary transfer rollers 5 at the image forming portions by the primary transfer high-voltage source 54, when Vd at each image forming portion is −600 V, the resultant transfer current is not 10 μA. For this reason, in this embodiment, the following setting is made.

First, the charge potentials of the photosensitive drums 1 at the respective image forming portions are set as follows from the temporary transfer voltages obtained by the ATVC described above and the transfer voltage Vtall.

$$Vda(\text{at } Pa)=Vd-(Vta-Vtall)$$

$$Vdb(\text{at } Pb)-Vd-(Vtb-Vtall)$$

$$Vdc(\text{at } Pc)-Vd-(Vtc-Vtall)$$

$$Vdd(\text{at } Pd)-Vd-(Vtd-Vtall)$$

When the above-described values are substituted into the equations, the following values are obtained.

$$Vda=-600-(200-230)=-570$$

$$Vdb=-600-(260-230)=-630$$

$$Vdc=-600-(260-230)=-585$$

$$Vdd=-600-(245-230)=-615$$

During the image formation, the voltages are applied to the charging rollers 2 at the image forming portions so that the above charge potentials can be obtained. Such calculations of the potentials as described above are performed by a calculating portion 31 incorporated into a control device 33 together with the primary transfer power source controller 30.

Then, voltages are set for the charging rollers 2*a*, 2*b*, 2*c* and 2*d*, respectively, so that the surface potentials of the photosensitive drums 1 at the respective image forming portions are set values, respectively. This setting is made by a setting portion 32 (setting means) incorporated into the control device 33.

The setting portion 32 also sets an exposure output and a developing bias with a change in charge potential of each of the photosensitive drums 1. The output of the laser light by the exposure device 3 and the developing bias applied to the developing sleeve 42 of the developing device 4 are changed with the same potential difference as that for the potential changed from the charge portion (−600 V). For example, in the case where the charge potential at the image forming portion Pa is changed from −600 V by 30 V in the positive direction to −570 V, the laser light output and the developing bias are also changed by 30 V in the positive direction. This is true for other image forming portions.

Incidentally, in this embodiment, the optimum potential contrast is obtained for the dark portion potential but can also be obtained for the light portion potential.

Figure 5:
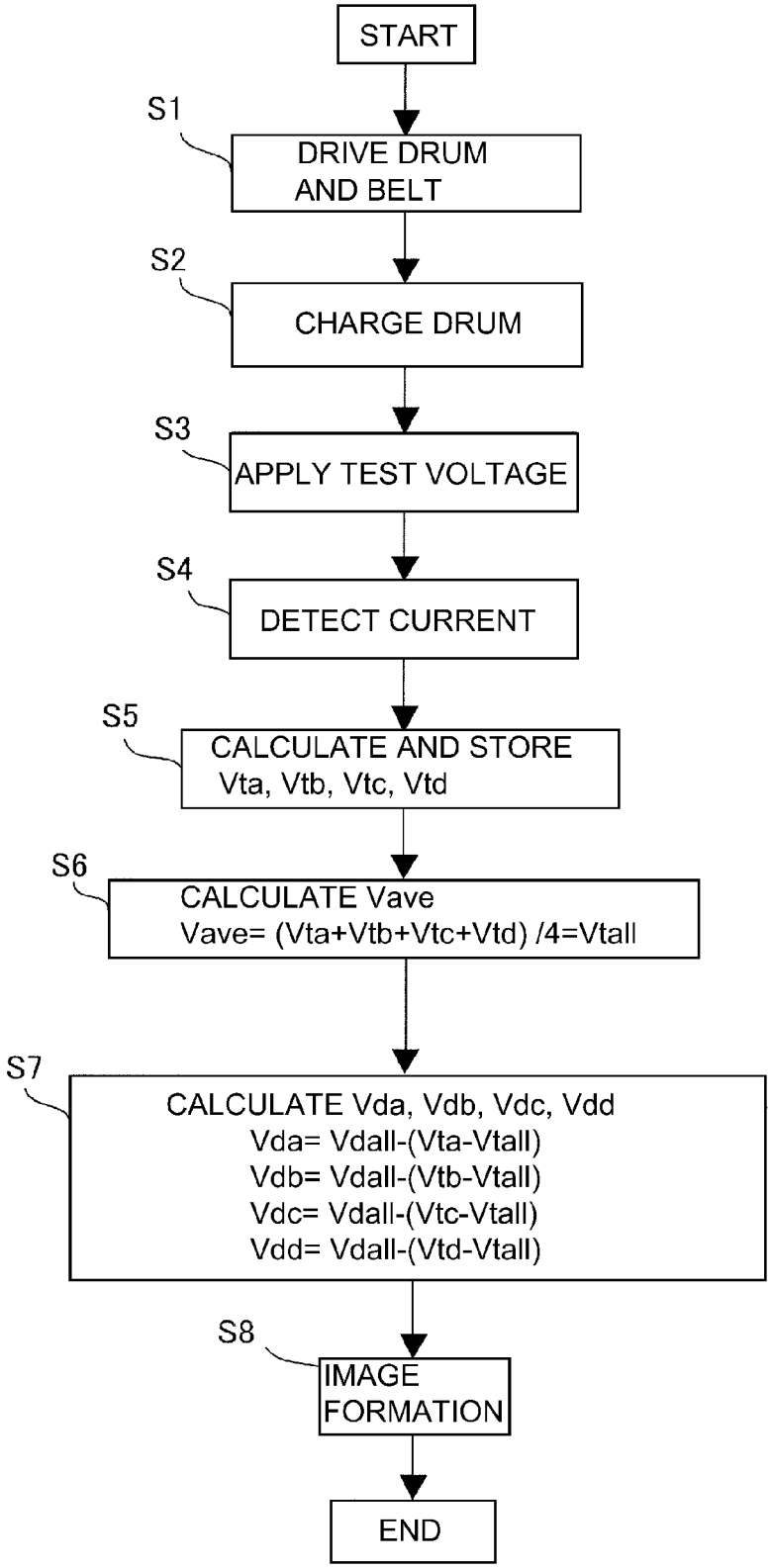
FIG. 5 is a flow chart of image formation in the embodiment.

The above-described is summarized along a flow as shown in FIG. 5. First, when the control is started, drive of the photosensitive drum 1 and the intermediary transfer belt 7 is started (S1). Then, the surface of the photosensitive drum 1 is charged to, e.g., −600 V (S2). When the surface of the photosensitive drum 1 is charged, in order to start the ATVC, first, the test voltages (Vft1, Vft2, Vft3) are successively applied (S3). Then, currents (Ift1, Ift2, Ift3) passing through the primary transfer roller 5 are detected (S4). Then, from a relationship between the applied voltage and the detected current, the optimum transfer biases (Vta, Vtb, Vtc, Vtd) at the respective image forming portions are obtained and stored in a storing means such as a memory incorporated into, e.g., the control device 33 (S5). Incidentally, these optimum transfer biases at the respective image forming portions are used as temporary transfer voltages.

Then, an average (Ave) of the these transfer voltages is obtained and is used as the transfer voltage (Vtall) to be applied from the primary transfer high-voltage source 54 (S6). Further, the charge potentials (Vda, Vdb, Vdc, Vdd) of the photosensitive drums 1 at the respective image forming portions are calculated from the temporary transfer voltages obtained by the above-described ATVC and the transfer voltage (Vtall) to be applied from the primary transfer high-voltage source 54, respectively (S7). In this state, the image formation started and the charge potentials of the photosensitive drums 1 at the respective image forming portions are set at the values calculated, respectively, in S7 and then, the transfer voltage (Vtall) obtained in S6 is applied from the primary transfer high-voltage source 54 (S8).

According to this thus-constituted embodiment, even when the primary transfer high-voltage source 54 for applying the transfer voltage is common to the plurality of image forming portions Pa, Pb, Pc and Pd, it is possible to reduce a degree of occurrences of improper transfer and image defect due to abnormal electric discharge. That is, on the basis of the currents passing through the primary transfer rollers 5 by applying the voltages to the primary transfer rollers 5 at the respective image forming portions, the charge potentials, Vda, Vdb, Vdc and Vdd of the photosensitive drums 1 are set, respectively, and the voltages applied to the charging rollers 2 are also set, respectively. Therefore, even when the same transfer voltage is applied in a state in which the resistance at the primary transfer portion N1 at each of the image forming portions is different, the photosensitive drum 1-side charge potentials are appropriately set and therefore at each of the primary transfer portions N1, an optimum current can be carried. As a result, irrespective of the deteriorations of the transfer rollers 5 and the intermediary transfer belt 7 by the image formation and the change in environment, the degree of occurrences of the improper transfer and the image defect due to the abnormal electric charge can be reduced.

Other Embodiments

In the above-described embodiment, the transfer voltage (Vtall) applied from the primary transfer high-voltage source 54 is the average of the optimum transfer biases at the respective image forming portions but Vtall is not limited thereto. For example, in the case where the charge potential of only one photosensitive drum cannot be sufficiently increased, the transfer voltage may also be set based on the charge potential of this photosensitive drum. That is, the transfer voltage may also be set depending on a condition of the photosensitive drum. In this case, depending on the set transfer voltage, the charge potentials of other photosensitive drums are set. Further, the transfer voltage depending on the associated device may also be set in advance. In this case, the control such as the ATVC can be omitted.

Further, in the ATVC in the embodiment described above, in the state in which the surface of the photosensitive drum 1 is charged to −600 V, the primary transfer high-voltage source 54 is controlled, so that the test voltages at three levels (Vft1, Vft2, Vft3) are successively applied. However, the voltages applied from the primary transfer high-voltage source are made a certain value and the surface potential of the develop 1 is changed at a plurality of levels, so that it is also possible to obtain a similar relationship.

Further, in the above-described embodiment, the constitution in which the power source is common to all the image forming portions is described but the present invention is also applicable to a constitution in which the power source is common to a part of the image forming portions. That is, similar control is effected between the image forming portions to which the power source is common, so that the degree of the occurrences of the improper transfer and the image defect due to the abnormal electric discharge can be reduced irrespective of the deterioration by the image formation.

Further, in the embodiment described above, the structure in which the transfer material is the intermediary transfer belt is described, but the transfer material may also be the recording material. That is, the present invention is also applicable to a structure in which the toner images formed on the photosensitive drums without via the intermediary transfer belt are directly transferred onto the recording material.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 105842/2011 filed May 11, 2011, which is hereby incorporated by reference.

What is claimed is:

1. An image forming apparatus comprising:

a first image forming portion including a first photosensitive member, a first charging member configured to electrically charge the first photosensitive member, a first exposure member configured to expose to light the charged first photosensitive member to form an electrostatic latent image, a first developing member configured to form a toner image by depositing a toner on an exposed portion of the electrostatic latent image, and a first transfer portion configured to transfer the toner image from the first photosensitive member onto a transfer material;

a second image forming portion including a second photosensitive member, a second charging member configured to electrically charge the second photosensitive member, a second exposure member configured to expose to light the charged second photosensitive member to form an electrostatic latent image, a second developing member configured to form a toner image by depositing a toner on an exposed portion of the electrostatic latent image, and a second transfer portion configured to transfer the toner image from the second photosensitive member onto the transfer material;

a power source configured to apply a common voltage to the first transfer portion and the second transfer portion; and a setting portion configured to variably set, for a period in which a transfer operation is performed, a potential of the exposed portion of the first photosensitive member exposed by the first exposure member and a potential of the exposed portion of the second photosensitive member exposed by the second exposure member on the basis of a plurality of currents passing through the first transfer portion and a plurality of currents passing through the second transfer portion, respectively, when a plurality of common voltages are applied to the first transfer portion and the second transfer portion in a period other than the period in which the transfer operation is performed.

2. An image forming apparatus according to claim 1, wherein said setting portion variably sets the potential of the exposed portion of the first photosensitive member and the potential of the exposed portion of the second photosensitive member by controlling an exposure amount of the first exposure member and an exposure amount of the second exposure member, respectively.

3. An image forming apparatus according to claim 1, wherein for the period other than the period in which the transfer operation is performed, said setting portion sets an absolute value of the potential of the exposed portion of the first photosensitive member so as to be smaller than an absolute value of the potential of the exposed portion of the second photosensitive member when an absolute value of the current passing through the first transfer portion is larger than an absolute value of the current passing through the second transfer portion when the common voltage is applied to the first transfer portion and the second transfer portion in the period other than the period in which the transfer operation is performed in a case where a potential of the first photosensitive member is equal to a potential of the second photosensitive member.

4. An image forming apparatus according to claim 1, wherein said setting portion variably sets, for a period in which a transfer operation is performed, a potential of the exposed portion of the first photosensitive member exposed by the first exposure member and a potential of the exposed portion of the second photosensitive member exposed by the second exposure member on the basis of a plurality of currents passing through the first transfer portion and a current passing through the second transfer portion when a certain voltage is applied to the first transfer portion and the second transfer portion, while setting a potential of each of the first photosensitive member and the second photosensitive member at a plurality of levels, in a period other than the period in which the transfer operation is performed.

5. An image forming apparatus comprising:

a first image forming portion including a first photosensitive member, a first charging member configured to electrically charge the first photosensitive member, a first exposure member configured to expose to light the charged first photosensitive member to form an electrostatic latent image, a first developing member configured to form a toner image by depositing a toner on a charged portion other than an exposed portion of the electrostatic latent image, and a first transfer portion configured to transfer the toner image from the first photosensitive member onto a transfer material;

a second image forming portion including a second photosensitive member, a second charging member configured to electrically charge the second photosensitive member, a second exposure member configured to expose to light the charged second photosensitive member to form an electrostatic latent image, a second developing member configured to form a toner image by depositing a toner on a charged portion other than an exposed portion of the electrostatic latent image, and a second transfer portion configured to transfer the toner image from the second photosensitive member onto the transfer material;

a power source configured to apply a common voltage to the first transfer portion and the second transfer portion; and a setting portion configured to variably set, for a period in which a transfer operation is performed, a potential of the charged portion of the first photosensitive member charged by the first charging member and a potential of the charged portion of the second photosensitive member charged by the second charging member on the basis of a plurality of currents passing through the first transfer portion and a plurality of currents passing through the second transfer portion, respectively, when a plurality of different common voltages are applied to the first transfer portion and the second transfer portion in a period other than the period in which the transfer operation is performed.

6. An image forming apparatus according to claim 5, wherein said setting portion variably sets the potential of the charged portion of the first photosensitive member and the potential of the charged portion of the second photosensitive member by controlling a voltage applied to the first charging member and a voltage applied to the second charging member, respectively.

7. An image forming apparatus according to claim 5, wherein for the period other than the period in which the transfer operation is performed, said setting portion sets an absolute value of the potential of the charged portion of the first photosensitive member so as to be larger than an absolute value of the potential of the charged portion of the second photosensitive member when an absolute value of the current passing through the first transfer portion is larger than an absolute value of the current passing through the second transfer portion when the common voltage is applied to the first transfer portion and the second transfer portion in the period other than the period in which the transfer operation is performed in a case where a potential of the first photosensitive member is equal to a potential of the second photosensitive member.

8. An image forming apparatus according to claim 5, wherein said setting portion variably sets, for a period in which a transfer operation is performed, a potential of the charged portion of the first photosensitive member charged by the first charging member and a potential of the charged portion of the second photosensitive member charged by the second charging member on the basis of a plurality of currents passing through the first transfer portion and a current passing through the second transfer portion when a certain voltage is applied to the first transfer portion and the second transfer portion, while setting a potential of each of the first photosensitive member and the second photosensitive member at a plurality of levels, in a period other than the period in which the transfer operation is performed.

* * * * *